US008175302B2

(12) United States Patent
Tanghe et al.

(10) Patent No.: US 8,175,302 B2
(45) Date of Patent: May 8, 2012

(54) DEVICE FOR AND METHOD OF GENERATING A VIBRATION SOURCE-DRIVING-SIGNAL

(75) Inventors: Loic Bernard Tanghe, Leuven (BE); Feng Lu, Shanghai (CN); Wilhelmus Maria Wagenaars, Leuven (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 1033 days.

(21) Appl. No.: 12/092,712

(22) PCT Filed: Nov. 7, 2006

(86) PCT No.: PCT/IB2006/054138

§ 371 (c)(1), (2), (4) Date: May 6, 2008

(87) PCT Pub. No.: WO2007/054888

PCT Pub. Date: May 18, 2007

(65) Prior Publication Data

US 2008/0240484 A1 Oct. 2, 2008

(30) Foreign Application Priority Data

Nov. 10, 2005 (EP) ..... 05110621

(51) Int. Cl.
*H04R 1/10* (2006.01)
*H04R 25/00* (2006.01)

(52) U.S. Cl. ..... 381/191; 381/74

(58) Field of Classification Search ..... 381/380, 381/151, 74, 182, 191; 700/94
See application file for complete search history.

(56) References Cited

U.S. PATENT DOCUMENTS

| | | | | |
|---|---|---|---|---|
| 5,638,305 | A * | 6/1997 | Kobayashi et al. | 700/280 |
| 6,288,320 | B1 * | 9/2001 | Murakami et al. | 84/622 |
| 6,369,312 | B1 | 4/2002 | Komatsu | |
| 6,603,863 | B1 | 8/2003 | Nagayoshi | |
| 2005/0036636 | A1 | 2/2005 | Noro et al. | |
| 2007/0223717 | A1 * | 9/2007 | Boersma | 381/74 |
| 2008/0188967 | A1 * | 8/2008 | Taub et al. | 700/94 |

FOREIGN PATENT DOCUMENTS

| | | | |
|---|---|---|---|
| EP | 1170709 | A2 | 1/2002 |
| EP | 1530400 | A1 | 5/2005 |
| GB | 2163284 | A | 2/1986 |
| GB | 2170666 | A | 8/1986 |

* cited by examiner

*Primary Examiner* — Anh Mai

(57) ABSTRACT

A device (100) for generating a vibration source driving signal (DS) is described, which device (100) comprises an input (101) for receiving an input signal (IS) and an output (102) for providing said driving signal (DS), generating means (103; 803) for generating a control signal (CS) which is representative of dynamic signal changes of the input signal (IS), and a processing unit (105; 201; 301; 401; 804) adapted to process a source signal (SRS; IAS) based on the control signal (CS) yielding said driving signal (DS).

17 Claims, 4 Drawing Sheets

DEVICE FOR AND METHOD OF GENERATING A VIBRATION SOURCE-DRIVING-SIGNAL

FIELD OF THE INVENTION

The invention relates to a device for generating a vibration source-driving signal.

The invention further relates to a method of generating a vibration source-driving signal.

The invention also relates to a program element.

Furthermore, the invention relates to a computer-readable medium.

BACKGROUND OF THE INVENTION

In the field of consumer electronics, devices with a vibration source or an internal vibration unit are becoming more and more important. Particularly, an increasing number of users are interested in vibration headphones or gaming headphones, i.e. headphone devices with internal vibration units aimed at providing gaming enthusiasts with an immersive sound experience that will dynamically add to the excitement and enjoyment of the latest action-packed computer, console and portable games.

Such a gaming headphone has been introduced on the market by the applicant and is known, for instance, by the model name of "SHG8100".

This known headphone combines hi-fi audio quality with a vibration system that matches the onscreen action of such a game with vibrations felt by the wearer through the headphones themselves. The vibration system is triggered by bass sounds, i.e. the low-frequency part of the audio signal in the soundtrack of a game, and creates a vibration effect. As a result, gamers literally feel game actions as they play the game.

However, in many cases, the low-frequency part of the audio signal is not suitable for generating vibration. In some cases, long stationary low-frequency sounds may generate long vibrations that may be annoying.

OBJECT AND SUMMARY OF THE INVENTION

It is an object of the invention to enhance the vibration feature in entertainment devices.

In order to achieve the object defined above, a device for generating a vibration source-driving signal, a method of generating a vibration source driving signal, a program element and a computer-readable medium as defined in the independent claims are provided.

In accordance with an embodiment of the invention, a device for generating a vibration source driving signal is provided, the device comprising an input for receiving an input signal and an output for supplying said driving signal, generating means adapted to generate a control signal which is representative of dynamic signal changes of the input signal, and a processing unit adapted to process a source signal based on the control signal yielding said driving signal.

In accordance with another embodiment of the invention, a method of generating a vibration source driving signal is provided, the method comprising the steps of: receiving an input signal, generating a control signal which is representative of dynamic signal changes of the input signal, and processing a source signal based on the control signal yielding said driving signal.

In accordance with yet another embodiment of the invention, a program element is provided, which, when being executed by a processor, is adapted to control or carry out a method of generating a vibration source driving signal having the above-mentioned features.

In accordance with a further embodiment of the invention, a computer-readable medium is provided, in which a computer program is stored which, when being executed by a processor, is adapted to control or carry out a method of processing audio data having the above-mentioned features.

The audio signal-processing operation in accordance with embodiments of the invention can be realized by a computer program, i.e. by software, or by using one or more special electronic optimization circuits, i.e. in hardware, or in a hybrid form, i.e. by means of software components and hardware components.

The characteristic features of the invention offer the advantage that a more dynamic vibration source-driving signal is generated. A vibration feature in entertainment devices may thus be enhanced as the vibration source-driving signal is supplied to a vibration source of the entertainment device.

The invention is further based on the recognition that, in certain cases, a low-frequency part of an input audio signal is not always suitable for generating vibrations so as to enhance a vibration feature. Hence, in an advantageous aspect of the invention, the generation of annoying long vibrations may be avoided for comparatively long stationary low-frequency sounds.

In an embodiment of the invention, for instance, in gaming applications, the vibration effect may be coincident with a visual effect of the gaming application.

Examples of applications of embodiments of the invention are all types of audio products with audio and vibration features, in particular in the field of consumer electronics and automotive equipment, for instance, vibration headphones or gaming headphones, and also vibration chairs or vibration shakers for home theaters or gaming applications, but also subwoofer shakers. A particularly interesting field of application of the invention is in a mobile telecommunication device or mobile phone for reproducing ringtones and/or music. A ringtone is the sound made by a telephone to indicate an incoming call. For ringtones, music reproduction and gaming applications on portable devices with an internal vibration motor, the sound experience can be enhanced considerably by using a vibration motor for low-frequency reproduction. In such an application, the vibration motor movement should have a close relation with the low-frequency content of the music, or the audio content of the game.

Embodiments of the device for generating a vibration source-driving signal will now be explained. However, these embodiments also apply to the method of generating a vibration source driving signal, the program element, and the computer-readable medium.

In the device for generating a vibration source driving signal, the generating means may comprise a first detection unit having a first time response, which first detection unit is adapted to supply the stationary signal, and a second detection unit having a second time response, which second detection unit is adapted to supply the fluctuating signal. Thus, the level difference of the signals of these two detection units may be used to generate a control signal that is directly related to the dynamic changes of the input signal, which control signal is used in a further processing operation.

In an embodiment, a low-pass filter may be used before the generating means. This focuses the generation of the vibration source-driving signal on a low-frequency signal part. In some applications, the purpose of vibration is to enhance the sensation of the low-frequency effect or assist the loudspeaker system that is not capable of producing sounds of a very low frequency. For such applications, the vibration signal comes from a low-frequency part of the signal; interferences of middle and high-frequency parts may advantageously be avoided. This may be particularly advantageous in applications in which the vibration motor represents or reproduces the low frequencies of the audio signal as a vibration only, not as audible sound, but has a direct relation with the frequency content of the audio signal.

Furthermore, the vibration motor control signal or vibration source driving signal is dynamic in the sense that it will follow dynamic changes in the audio signal (for example, sound related to an explosion in a game scene, rhythm in music, etc.) but will not react to steady-state audio signals, thus creating a powerful vibration experience.

In a further embodiment, band pass filters may be used for one or each detection unit. Moreover, in an embodiment, an enhanced calculation method may be used to generate the control signal. In some applications, the purpose is not only to enhance the low-frequency sensation, but also to emphasize some transient signal such as, for instance, a gun shoot, a hit or a similar feature in computer game applications. These signals contain the full frequency content and should be distinguished from other transient signals such as speech. The purpose of several band pass filters and level detectors is to provide frequency-band information for post-calculation or generation of the control signal.

In another embodiment, the input signal may be an audio signal provided by an audio data-processing device. The audio signal itself may contain a dynamic (fluctuating) part signal, which may be a wide-band signal. In a further embodiment, the source signal may be the audio signal. Advantageously, such an embodiment may be implemented as a product, which is compatible with an audio device and vibration unit applications without additional source signal input. Moreover, the vibration unit may advantageously produce wide-band vibration.

In a further embodiment, it is possible to apply the system for a combination of audio signals and video signals. For instance, an embodiment of the invention may be implemented in audiovisual applications such as a video player or a home cinema system, or a video game system.

The audio data-processing device may be a CD player, a DVD player, a hard disk-based media player, an Internet radio device, a public entertainment device, an MP3 player, a vehicle entertainment device, a car entertainment device, a portable audio player, a portable video player, a mobile phone, a medical communication system, a body-worn device, or a hearing aid device. A "car entertainment device" may be a hi-fi system for an automobile.

These and other aspects of the invention are apparent from and will be elucidated with reference to the embodiments described hereinafter.

DESCRIPTION OF EMBODIMENTS

Figure 1:
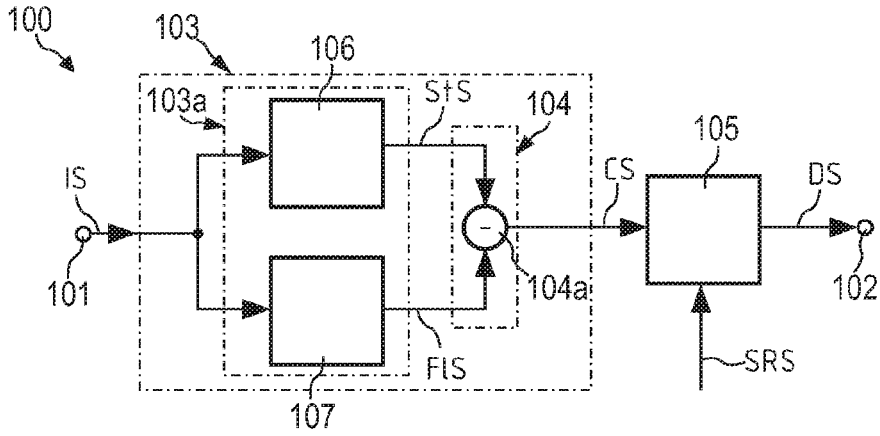
FIG. 1 shows a device for generating a vibration source-driving signal in accordance with an embodiment of the invention.

The illustrations in the drawings are schematic. In different drawings, similar or identical elements are denoted by the same reference signs.

A device 100 for generating a vibration source-driving signal in accordance with an embodiment of the invention will now be described with reference to FIG. 1.

The device 100 for generating a vibration source driving signal DS comprises an input 101 for receiving an input signal IS and an output 102 for supplying said driving signal DS, generating means 103 adapted to generate a control signal CS which is representative of dynamic signal changes of the input signal IS, and a processing unit 105 adapted to process a source signal SRS based on the control signal CS yielding said driving signal DS.

In the present case, the generating means 103 comprises an extraction unit 103*a* adapted to extract or generate a stationary signal StS and a fluctuating signal FlS from the input signal IS, and combining means 104 for generating the control signal CS based on a combination of said stationary signal StS and said fluctuating signal FlS. The extraction unit 103*a* comprises a first detection unit 106 having a first time response, which first detection unit 106 is adapted to supply the stationary signal StS, and a second detection unit 107 having a second time response, which second detection unit 107 is adapted to supply the fluctuating signal FlS. Furthermore, the first detection unit 106 is adapted as a root-mean-square (RMS) detector having a comparable, slow time response, and the second detection unit 107 is adapted as a peak detector having a comparable, fast time response. In the present case, the root-mean-square (RMS) detector has a time response of 0.05 second and the peak detector has a time response of 0.01 second. Other time response values may be appropriate, for example, 10% to 50% above or below the values mentioned. Note that, in a further embodiment, parameter setting means may be provided, which parameter setting means are designed to tune or adapt the time responses.

It should be noted that the detection units may be based on other detectors, for example, a further peak detector may be provided instead of the root-mean-square (RMS) detector, the further peak detector then having a comparable, slow time response.

The combining means 104 for generating the control signal CS are adapted as a subtraction unit for subtracting the fluctuating signal FlS from the stationary signal StS, or vice versa.

A further device 200 for generating a vibration source-driving signal in accordance with an embodiment of the invention will now be described with reference to FIG. 2.

Figure 2:
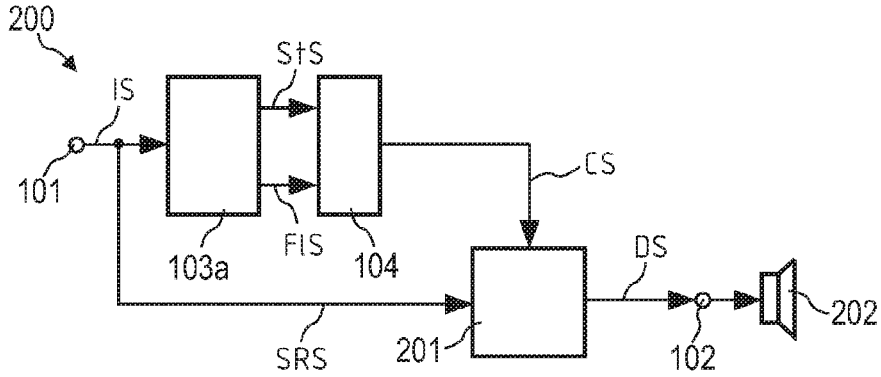
FIG. 2 shows a further device for generating a vibration source-driving signal in accordance with an embodiment of the invention.

The device 200 shown in FIG. 2 differs from the device 100 of FIG. 1 in that the processing unit 105 shown in FIG. 1 is designed as a gain control unit 201 adapted to receive the input signal IS as the source signal and to control the input signal IS based on the control signal CS so as to receive the driving signal DS.

In the present case, the driving signal DS can be supplied to an electrodynamic vibration unit 202, which acts as a vibration source for generating vibrations based on the driving signal DS. In principle, the electrodynamic vibration unit 202 is similar to a normal loudspeaker. In the present case, the input signal IS may be an audio signal, which may be modulated in the gain control unit 201 based on the control signal CS. A stationary signal part of the input signal IS may thereby be compressed and a dynamically fluctuating signal part of the input signal IS may be emphasized.

Figure 5:
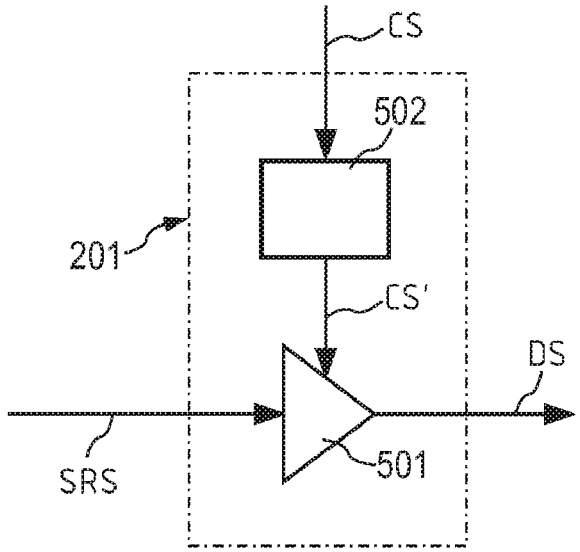
FIG. 5 shows a detailed embodiment of the processing unit of the device for generating a vibration source-driving signal in accordance with an embodiment of the invention.

FIG. 5 shows a detailed embodiment of the gain control unit 201.

The gain control unit 201 comprises an amplifier 501 and dynamic range manipulation means 502, which are adapted to manipulate the control signal CS yielding a manipulated control signal CS', and which amplifier 501 is adapted to amplify the source signal SRS based on the manipulated control signal CS'. The dynamic range manipulation means 502 may be a dynamic compressor or expander.

A further device 300 for generating a vibration source-driving signal in accordance with an embodiment of the invention will now be described with reference to FIG. 3.

Figure 3:
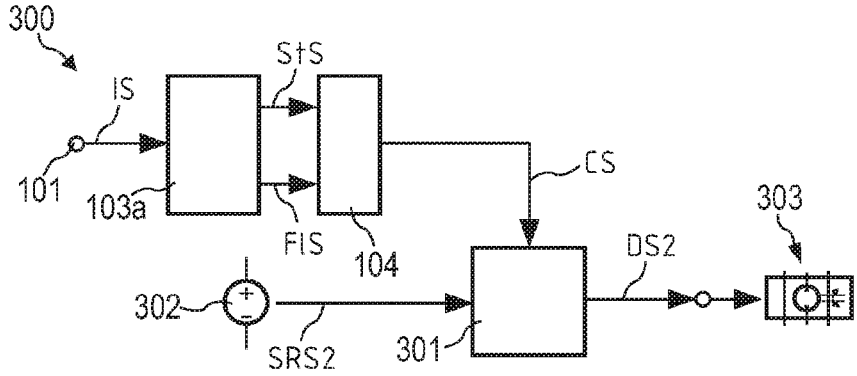
FIG. 3 shows a further device for generating a vibration source-driving signal in accordance with an embodiment of the invention.

The device 300 shown in FIG. 3 differs from the device 200 of FIG. 2 in that the gain control unit 201 shown in FIG. 2 is designed as a gain control unit 301 adapted to receive an input DC voltage as a source signal SRS2 and to control the source signal SRS2 based on the control signal CS so as to receive a driving signal DS2. The input DC voltage may be provided by a DC voltage source 302. In the present case, the DC voltage source 302 is provided by the same power source (not shown) as that used for powering the device 300. However, the DC voltage source 302 may be any device or system that produces an electromotive force between at least two terminals, or derives a secondary voltage from a primary source of the electromotive force.

In the present case, the driving signal DS2 can be supplied to a DC motor 303, which acts as a vibration source for generating vibrations based on the driving signal DS2. The DC motor 303 may only produce vibrations with a fixed frequency and may respond to a dynamic part of the input signal IS by means of the control of the control signal CS.

A further device 400 for generating a vibration source-driving signal in accordance with an embodiment of the invention will now be described with reference to FIG. 4.

Figure 4:
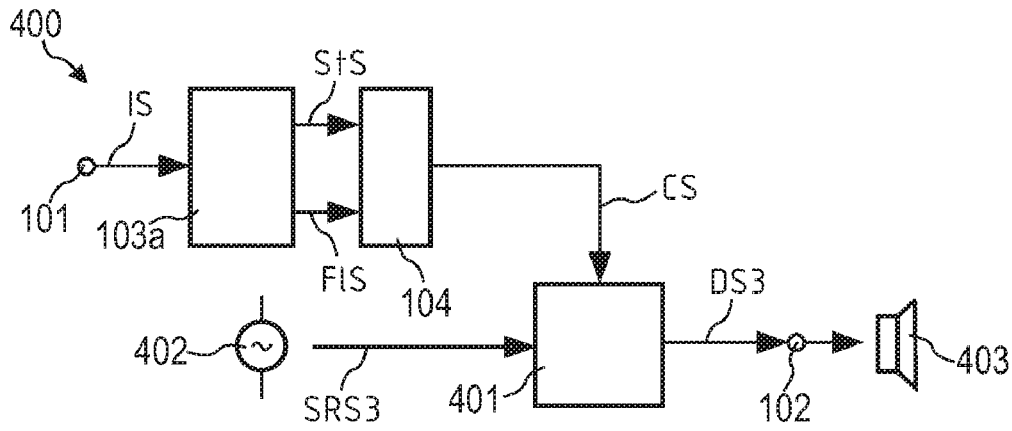
FIG. 4 shows a further device for generating a vibration source-driving signal in accordance with an embodiment of the invention.

The device 400 shown in FIG. 4 differs from the device 200 of FIG. 2 in that the gain control unit 201 shown in FIG. 2 is designed as a gain control unit 401 adapted to receive an input AC voltage as a source signal SRS3 and to control the source signal SRS3 based on the control signal CS so as to yield a driving signal DS3. The input AC voltage may be provided by any suitable AC voltage source 402 known to the skilled person. In the present case, the driving signal DS3 can be supplied to a high-Q-factor vibration unit 403, which acts as a vibration source for generating vibrations based on the driving signal DS3. The high-Q-factor vibration unit 403 has the property of a comparatively narrow and a comparatively high resonance resistance peak. In other words, the high-Q-factor vibration unit 403 has such a property that it can produce a comparatively large output signal at resonance frequency and has a comparatively narrow response frequency band. This may generate high-level vibrations based on a low-level signal at only this resonance frequency of the vibration unit.

The AC voltage source 402 is adapted to provide a single frequency signal and here the control signal CS is used to control the amplitude of this single frequency signal. The high-Q-factor vibration unit 403 may thereby only respond to the dynamic part of the input signal IS.

Figure 6:
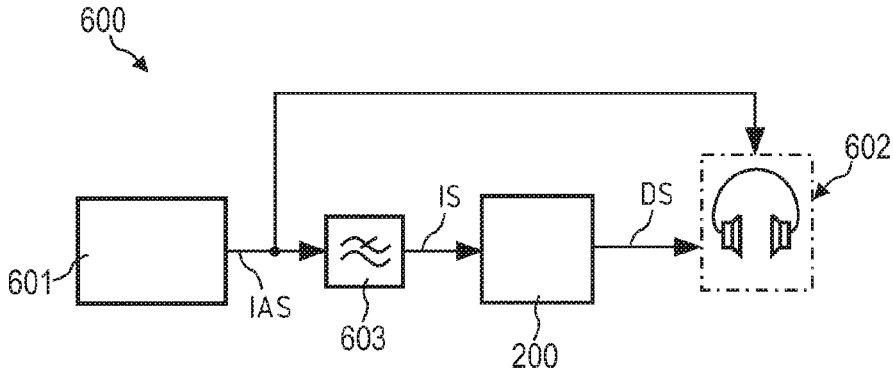
FIG. 6 shows an audio signal-processing system in accordance with an embodiment of the invention.

An audio signal-processing system 600 in accordance with an embodiment of the invention will now be described with reference to FIG. 6.

In the present case, the audio signal-processing system 600 comprises a device 200 for generating a vibration source driving signal DS as shown in FIG. 2 and a sound signal source 601 adapted to provide an input audio signal IAS. Furthermore, a headphone 602 is provided, which comprises transducer means (not shown in FIG. 6) for transducing the input audio signal IAS to sound, and a vibration source (not shown in FIG. 6) for generating vibrations based on the driving signal DS. In this case, the transducer means may be any suitable loudspeaker for a headphone known to the skilled person.

In the present case, the audio signal-processing system 600 further comprises a low-pass filter 603 adapted to receive the input audio signal IAS and to apply a low-pass filtered input audio signal as an input signal IS to the device 200 for generating a vibration source driving signal DS. In some applications, the purpose of vibration is to enhance the sensation of the low-frequency effect or to assist the loudspeaker system that is not capable of producing sounds of a very low frequency. For such applications, the vibration signal is advantageously derived from a low-frequency part of an input signal, and interferences of middle and high-frequency parts of the input signal are avoided.

Figure 7:
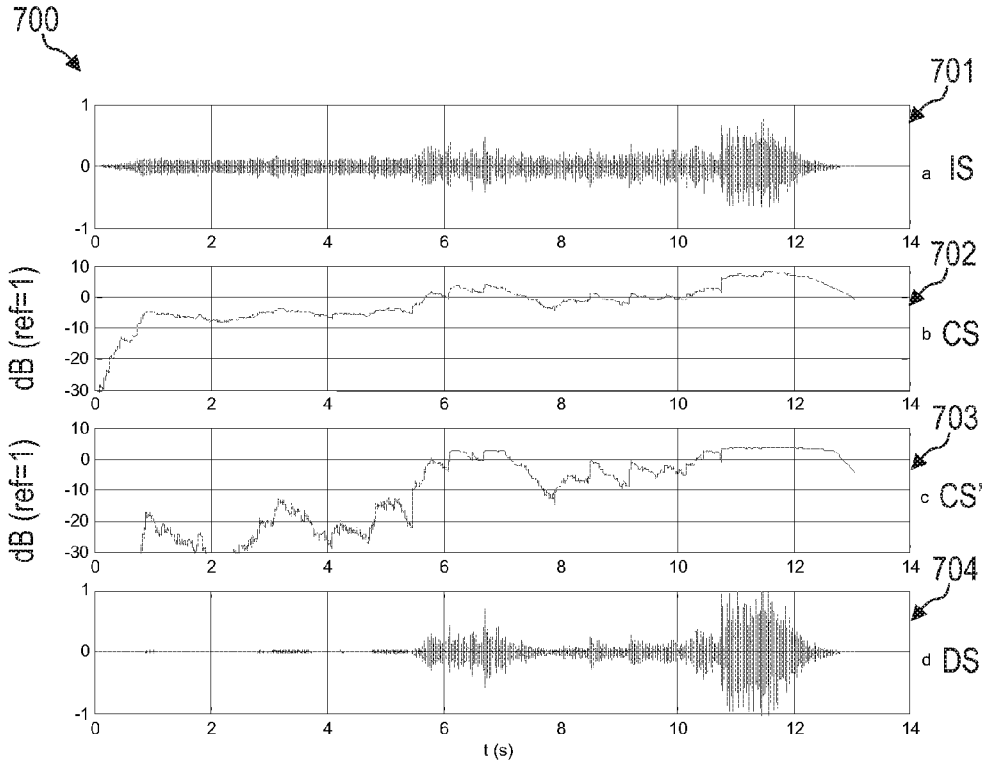
FIG. 7 shows diagrams of signals occurring in the device for generating a vibration source-driving signal in accordance with an embodiment of the invention.

A diagram 700 of signals occurring in a device 200 for generating a vibration source-driving signal in accordance with an embodiment of the invention will now be described with reference to FIG. 7.

In the present case, the signals shown in the signal diagram 700 refer to the device 200 shown in FIG. 2.

In the signal diagram 700, a first plot 701 is a low-pass filtered audio signal representing the input signal IS. A second plot 702 shows a control signal CS generated by the combining means 104. A third plot 703 shows the output signal of the dynamic range manipulation means 502, which is the manipulated control signal CS' for controlling, via the amplifier 501, the gain of the low-pass filtered audio signal. A fourth plot 704 shows the driving signal DS outputted from the amplifier 501. The fourth plot 704 clearly shows that the stationary parts or steady-state parts, respectively, of the input signal IS have been removed or at least significantly attenuated, whereas dynamic parts have been amplified.

Figure 8:
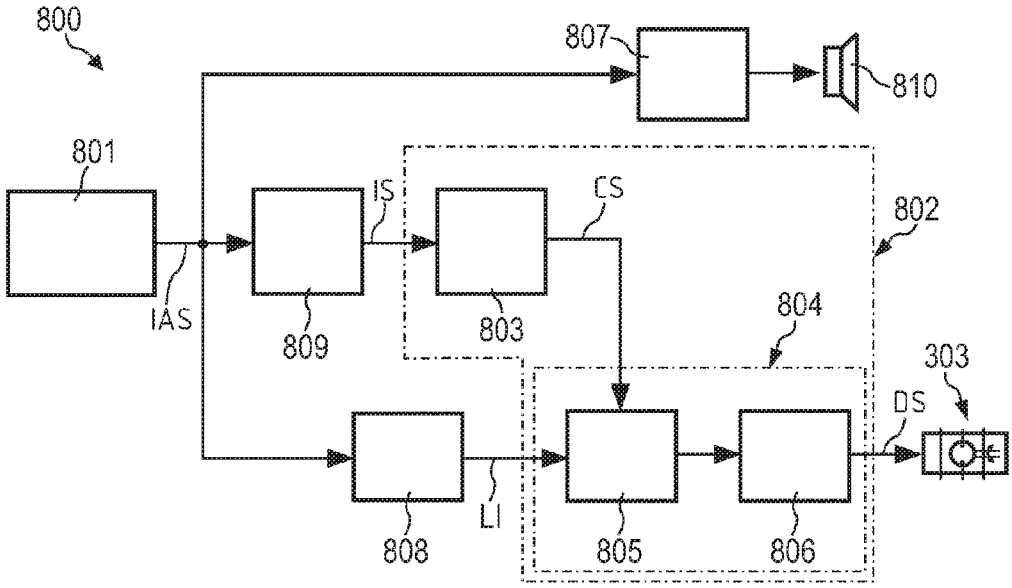
FIG. 8 shows an audio signal-processing system in accordance with an embodiment of the invention.

An audio signal-processing system 800 according to a further embodiment of the invention will now be described with reference to FIG. 8.

The audio signal-processing system 800 is adapted as a portable device such as a mobile phone and comprises an audio signal source 801, a device 802 for generating a vibration source driving signal DS, an audio signal modification unit 807, a level detector 808, and an envelope determination unit 809. The device 802 for generating the vibration source-driving signal DS comprises generating means 803 and a processing unit 804. The processing unit 804 comprises a comparator 805 and a motor control unit 806. The motor control unit 806 applies the driving signal DS to a vibration motor 303.

In the present case, the audio signal source 801 is a stereo signal source comprising a stereo audio signal, i.e. a left and a right audio signal.

Figure 10:
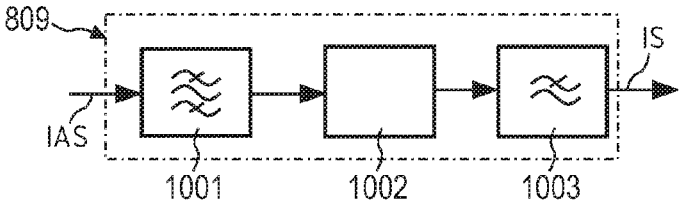
FIG. 10 shows a detailed embodiment of an envelope determination unit shown in FIG. 8.

The envelope determination unit 809 is shown in more detail in FIG. 10. The envelope determination unit 809 comprises a band pass filter 1001, an envelope detector 1002, and a low-pass filter 1003. The band pass filter 1001 is adapted to process the input audio signal IAS and to apply a filtered-filtered audio signal to the envelope detector 1002. The envelope detector 1002 applies an envelope signal to the low-pass filter 1003, which outputs a low-pass filtered signal IS to the generating means 803. A Butterworth band-pass filter of filter order 2 to 3 per slope in this case constitutes the band-pass filter 1001. As this embodiment has for its purpose to enhance bass effects but not to have the system react to every possible bass event, the band-pass filter is best limited to the "punchy bass" frequency range of 60 Hz to 200 Hz. It may be mentioned that other filters may be used, for example, an elliptical or Chebychev filter, and other frequency ranges may be used, for example a frequency range of 40 Hz to 150 Hz.

The envelope detector 1002 simply provides the absolute value of the bandpass-filtered audio signal as the envelope signal. Other functions are possible, for example, by determining the RMS value.

In this case, the low-pass filter 1003 is a Butterworth low-pass filter of filter order 1 Hz and a cut-off frequency of 5 Hz. As will be evident to the skilled person, filters having a similar function may also be used.

Figure 9:
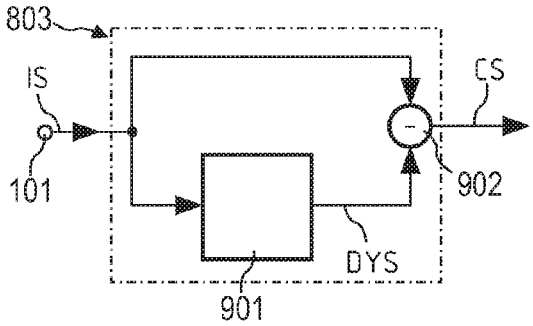
FIG. 9 shows a detailed embodiment of the generating means shown in FIG. 8.

The generating means 803 are illustrated in more detail in FIG. 9. The generating means 803 comprises a delay unit 901 for delaying the input signal IS, yielding a delayed signal DYS, and a subtracting unit 902 adapted to subtract the delayed signal DYS from the input signal IS, yielding the control signal CS. In other words, in the generating means 803, the output signal from the envelope determination unit 809 is delayed and subtracted from this output signal of the envelope determination unit 809. In this way, changes in the input signal are emphasized while steady-state signals are removed. A delay time of the delay unit 901 may be specified between 100 milliseconds and 200 milliseconds, depending on the desired strength of the vibration effect.

Figure 11:
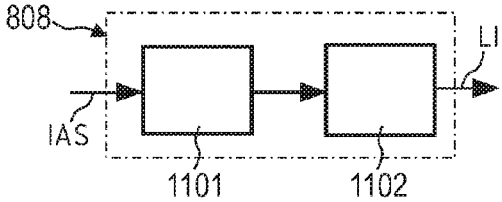
FIG. 11 shows a detailed embodiment of a level detector shown in FIG. 8.

There will be level differences during any ringtone or piece of music, or between different pieces of music provided by the signal source 801. In order to have a vibration effect at both high and low levels of the input audio signal IAS, the level of this input audio signal IAS will be used as a reference for the vibration effect. This input level is determined by means of the level detector 808, which is described in more detail with reference to FIG. 11. The level detector 808 is adapted to provide level information LI of the signal level of the source signal IAS.

In the present case, the level detector 808 is adapted as dynamic level detector 1101 for following changes in the level of the source signal IAS yielding a dynamic level signal, and applies this dynamic level signal to a threshold unit 1102, which is adapted to provide said level information LI based on the dynamic level signal and a threshold value.

The dynamic level detector 1101 will follow changes in the average level of the input audio signal IAS. It makes use of an attack and decay time and has only the purpose of following the long turn average level of the input audio signal IAS. The attack and release times can be relatively long.

The applied integrator-based level detector of the dynamic level detector 1101 is defined by the following equation:

$$y[n]=|x[n]|+KP*(y[n-1]-|x[n]|)+KM*|(y[n-1]-|x[n]|)|$$

with:

$$KP=\frac{(Kr+Ka)}{2}$$

$$KM=\frac{(Kr-Ka)}{2}$$

and:

$$Ka=\exp\left(\frac{-1}{Ta}\right)$$

$$Kr=\exp\left(\frac{-1}{Tr}\right)$$

Here, Ta denotes the attack time and Tr denotes the release time of the detector. In the current application, the attack time is 0.1 second and the release time is 0.1 second. It may be mentioned that other values for the attack time and release time may be applied, for instance, the previous example divided or multiplied by a factor of two (2) or three (3), and so forth.

The system should not react to low-level noise or "rumble" in the input audio signal IAS, but only react as the input audio signal IAS reaches a certain level. For this reason, the threshold unit 1102 is provided. The applied threshold value of the threshold unit 1102 may depend on the internal signal levels of the mobile device (or mobile phone), for example, it may be ⅕th to ⅙th of the peak level of the dynamic level detector 1101.

As already mentioned, the processing unit 804 comprises the comparator 805 and the motor control unit 806. The comparator 805 is adapted to generate a PWM signal on the basis of the control signal CS and the level information LI as shown in the Table below:

| | PWM signal output comparator |
|---|---|
| Control signal CS < level information LI | 0 |
| Control signal CS >= level information LI | 1 |

The output of the comparator 805 is applied to the motor control unit 806. In this motor control unit 806, the PWM signal from the comparator 805 is transferred into a dedicated vibration source driving signal DS for the vibration motor 303. This vibration source driving signal DS is dependent on the architecture of the mobile device (or mobile phone) and the applied vibration motor 303.

In other words, the vibration motor 303 will move as a function of the low-frequency content of the input audio signal IAS (music or song or game), while the vibration motor 303 will not turn in the case of steady-state signals in the input audio signal IAS. For music and ringtones, this means that the vibration source driving signal DS will follow the beat or rhythm of the song, while it will enhance low-frequency effects such as explosions or accelerating cars in games.

The audio signal modification unit 807 is adapted to process the input audio signal IAS and to apply a processed or modified audio signal to a sound reproduction means 810, which is a loudspeaker in this case. The audio signal modification unit 807 comprises a high-pass filter followed by a delay. The high-pass filter is used to prevent that the loudspeaker is operated below its operating frequency range, and is thus overloaded. The cut-off frequency of the high-pass filter is determined by the specification of the loudspeaker. The high-pass filter may be a Butterworth filter of filter order 2 to 3 and a cut-off frequency in a frequency range of 250 Hz to 500 Hz or 600 Hz.

The delay is needed to compensate the inertia of the vibration motor 303. Because of this inertia, it will take some time before the vibration motor 303 is turning and the vibrations are felt. Without the delay, the vibration motor movement would be lagging behind the input audio signal IAS. A delay of about 50 milliseconds to 100 milliseconds may be applied.

It should be noted that use of the verb "comprise" and its conjugations does not exclude other elements or steps and use of the article "a" or "an" does not exclude a plurality. Also elements described in association with different embodiments may be combined.

It should also be noted that reference signs in the claims should not be construed as limiting the scope of the claims.

The mere fact that certain measures are recited in mutually different dependent claims does not indicate that a combination of these measures cannot be used to advantage.

The invention claimed is:

1. A system for generating vibrations based on a vibration source driving signal (DS), the system comprising an input for receiving an input signal (IS) and an output for supplying said driving signal (DS), generating means adapted to generate a control signal (CS) which is representative of dynamic signal changes of the input signal (IS), a processing unit adapted to process a source signal (SRS; IAS) based on the control signal (CS) yielding said driving signal (DS), and a vibration source for generating vibrations based on the driving signal.

2. The system according to claim 1, wherein the generating means are adapted to generate a stationary signal (StS) and a fluctuating signal (F1S) from the input signal (IS) and are adapted to generate said control signal (CS) based on a combination of said stationary signal (StS) and said fluctuating signal (F1S).

3. The system according to claim 2, wherein the generating means comprises a first detection unit having a first time response, which first detection unit is adapted to supply the stationary signal (StS), and a second detection unit having a second time response, which second detection unit is adapted to supply the fluctuating signal (F1S).

4. The system according to claim 1, wherein the generating means comprises a delay unit for delaying the input signal (IS) yielding a delayed signal (DYS), and a subtracting unit adapted to subtract the delayed signal (DYS) from the input signal (IS) yielding said control signal (CS).

5. The system according to claim 4, additionally comprising an envelope determination unit adapted to process the input signal yielding an envelope signal, wherein the generating means are adapted to determine from the envelope signal a steady-state signal yielding said control signal (CS).

6. The system according to claim 4, comprising a level detector adapted to provide level information (LI) of the signal level of the source signal (IAS), wherein the processing unit is adapted to generate said driving signal (DS) based on the level information (LI) and the control signal (CS).

7. The system according to claim 6, wherein the level detector is adapted as dynamic level detector for following changes in the level of the source signal (IAS) yielding a dynamic level signal, and wherein a threshold unit is provided, which threshold unit is adapted to provide said level information (LI) based on the dynamic level signal and a threshold value.

8. The system according to claim 1, wherein the processing unit is adapted as a gain control unit comprising an amplifier and dynamic range manipulation means which dynamic range manipulation means are adapted to manipulate the control signal (CS) yielding a manipulated control signal (CS') and which amplifier is adapted to amplify the source signal (SRS) based on the manipulated control signal (CS').

9. The system according to claim 1, wherein the source signal is the input signal or a direct-current signal or an alternating-current signal.

10. An audio signal-processing system, comprising the system for generating a vibration source driving signal according to claim 1, and a vibration source for generating vibrations based on the driving signal (DS), and/or an audio signal source adapted to provide an input audio signal (IAS).

11. The system according to claim 10, wherein the vibration source is adapted as an electrodynamic vibration unit or a vibration direct-current motor or an electrically resonant system having a high Q-factor.

12. The system according to claim 10, additionally comprising sound reproduction means adapted to reproduce sound based on the input audio signal (IAS).

13. The system according to claim 12, comprising a modification unit adapted to modify the input audio signal (IAS) for reproduction by the sound reproduction means, which modification unit comprises a high-pass filter and/or a delay circuit.

14. The system according to claim 10, realized as at least one of the group consisting of a vibration headphone, a gaming headphone, a vibration chair, a vibration shaker, a subwoofer, a CD player, a DVD player, a hard disk-based media player, an Internet radio device, a public entertainment device, an MP3 player, a vehicle entertainment device, a car entertainment device, a portable audio player, a portable video player, a mobile phone, a medical communication system, a body-worn device, and a hearing aid device.

15. A method of generating vibrations in a vibration source based upon a vibration source driving signal (DS), the method comprising the steps of:

receiving an input signal (IS), deriving a control signal (CS) which is representative of dynamic signal changes of the input signal (IS), processing a source signal (SRS; IAS) based on the control signal (CS) yielding said driving signal (DS), and providing said driving signals (DS) to the vibration source.

16. A computer-readable medium, in which a computer program is stored which, when being executed by a processor, is adapted to control or carry out a method of generating a vibration source driving signal (DS), the method comprising the steps of:

receiving an input signal (IS), generating a control signal (CS) which is representative of dynamic signal changes of the input signal (IS), processing a source signal (SRS; IAS) based on the control signal (CS) yielding said driving signal (DS), and transmitting said driving signal (DS) to a vibration source.

17. An audio signal-processing system, comprising:

A device for generating a vibration source driving signal (DS), the device comprising:

an input for receiving an input signal (IS) and an output for supplying said driving signal (DS), generating means adapted to generate a control signal (CS) which is representative of dynamic signal changes of the input signal (IS), and a processing unit adapted to process a source signal (SRS; IAS) based on the control signal (CS) yielding said driving signal (DS);

a vibration source for generating vibrations based on the driving signal (DS), and/or an audio signal source adapted to provide an input audio signal (IAS), and sound reproduction means adapted to reproduce sound based on the input audio signal (IAS).

* * * * *